US012571067B2

(12) United States Patent
Wu et al.

(10) Patent No.: US 12,571,067 B2
(45) Date of Patent: Mar. 10, 2026

(54) HIGH-STRENGTH THIN-GAUGE CHECKERED STEEL PLATE/STRIP AND MANUFACTURING METHOD THEREFOR

(71) Applicant: BAOSHAN IRON & STEEL CO., LTD., Shanghai (CN)

(72) Inventors: Jianchun Wu, Shanghai (CN); Yuan Fang, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 631 days.

(21) Appl. No.: 17/761,706

(22) PCT Filed: Sep. 17, 2020

(86) PCT No.: PCT/CN2020/115955
§ 371 (c)(1),
(2) Date: Mar. 18, 2022

(87) PCT Pub. No.: WO2021/052428
PCT Pub. Date: Mar. 25, 2021

(65) Prior Publication Data

US 2022/0340994 A1 Oct. 27, 2022

(30) Foreign Application Priority Data

Sep. 19, 2019 (CN) ..... 201910888774.5

(51) Int. Cl.
*C21D 9/52* (2006.01)
*B21B 1/46* (2006.01)
(Continued)

(52) U.S. Cl.
CPC ..... *C21D 9/52* (2013.01); *B21B 1/46* (2013.01); *B21B 37/74* (2013.01); *B21B 45/02* (2013.01);
(Continued)

(58) Field of Classification Search
CPC ..... B21B 1/46; B21B 1/463; B21B 27/005; B21B 37/74; B21B 45/02; B21B 27/021;
(Continued)

(56) References Cited

U.S. PATENT DOCUMENTS 6,406,564 B1 6/2002 Muraki et al.
9,790,566 B2 10/2017 Wang et al.
(Continued)

FOREIGN PATENT DOCUMENTS

CA 2369510 * 10/2001
CN 1753744 A 3/2006
(Continued)

OTHER PUBLICATIONS

Hardenability of Carbon and Alloy Steels, Metals Handbook Desk Edition, 2nd ed., Edited by Joseph R. Davis, ASM International, 1998, p. 269-274, https://doi.org/10.31399/asm.hb.mhde2.a0003103 (Year: 1998).*
(Continued)

*Primary Examiner* — Nicholas A Wang
(74) *Attorney, Agent, or Firm* — Lei Fang, Esq.; Smith Tempel Blaha LLC

(57) ABSTRACT

Provided are a high-strength thin-gauge checkered steel plate/strip comprising the following chemical elements in weight percentages: C: ≤0.06%, Si: ≤0.5%, Mn: 0.4-1.7%, P≤0.04%, S≤0.007%, N: 0.004-0.010%, Als: <0.001%, B: 0.001-0.006%, Mn/S≥250, total oxygen $[O]_T$: 0.007-0.020%; Cu: 0.1-0.6% and/or Sn: 0.005-0.04%; and a balance of Fe and other unavoidable impurities, and a manufacturing method thereof. The resultant steel roll can be used directly as hot-rolled checkered plate/strip, or as a finished checkered plate/strip after being cut and finished, and is
(Continued)

widely applicable to the fields of architecture, mechanical production, automobile, bridges, transportation, ship building, etc.

16 Claims, 4 Drawing Sheets

(51) Int. Cl.

| | |
|---|---|
| ***B21B 37/74*** | (2006.01) |
| ***B21B 45/02*** | (2006.01) |
| ***B22D 11/055*** | (2006.01) |
| ***B22D 11/06*** | (2006.01) |
| ***C21C 5/52*** | (2006.01) |
| ***C21D 6/00*** | (2006.01) |
| ***C21D 8/02*** | (2006.01) |
| ***C21D 8/0221*** | (2026.01) |
| ***C21D 8/0247*** | (2026.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/16*** | (2006.01) |

(52) U.S. Cl.
CPC ..... *B22D 11/055* (2013.01); *B22D 11/0622* (2013.01); *C21C 5/52* (2013.01); *C21D 6/005* (2013.01); *C21D 6/008* (2013.01); *C21D 8/0205* (2013.01); *C21D 8/0226* (2013.01); *C21D 8/0263* (2013.01); *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/16* (2013.01); *C21D 2211/005* (2013.01); *C21D 2211/009* (2013.01)

(58) Field of Classification Search
CPC ..... B21B 37/58; B21B 45/0233; B21H 8/005; B29C 59/04; C21D 1/02; C21D 1/60; C21D 1/613; C21D 1/667; C21D 1/76; C21D 2211/005; C21D 2211/009; C21D 2261/00; C21D 6/005; C21D 6/008; C21D 8/0205; C21D 8/0215; C21D 8/0226; C21D 8/0263; C21D 9/52; C21D 9/573; C22C 33/04; C22C 38/001; C22C 38/002; C22C 38/008; C22C 38/02; C22C 38/04; C22C 38/06; C22C 38/16; C22C 33/06
See application file for complete search history.

(56) References Cited

U.S. PATENT DOCUMENTS

| | | | | |
|---|---|---|---|---|
| 2003/0121577 | A1* | 7/2003 | Choi | C22C 38/04 148/330 |
| 2010/0186856 | A1* | 7/2010 | Williams | C21D 6/02 148/541 |
| 2014/0366602 | A1 | 12/2014 | Fang et al. | |
| 2018/0257133 | A1 | 9/2018 | Killmore et al. | |

FOREIGN PATENT DOCUMENTS

| | | | |
|---|---|---|---|
| CN | 101716608 | * | 6/2010 |
| CN | 101716608 | A | 6/2010 |
| CN | 103667895 | A | 3/2014 |
| CN | 107716552 | A | 2/2018 |
| CN | 108884533 | A | 11/2018 |
| EP | 1254275 | A1 | 11/2002 |
| EP | 1587642 | A1 | 10/2005 |
| JP | 2000254710 | * | 9/2000 |
| JP | 2015028199 | * | 2/2015 |
| KR | 20130072700 | A | 7/2013 |
| WO | 2004/065039 | A1 | 8/2004 |

OTHER PUBLICATIONS

Liu, H. et al. "Effect of total oxygen content on the machinability of low carbon resulfurized free cutting steel." 2012. Steel research int. 83. 12. p. 1172-1180. (Year: 2012).*
International Search Report for PCT/CN2020/115955 dated Dec. 16, 2020.
International Written Opinion for PCT/CN2020/115955 dated Dec. 16, 2020.
EP Search Report on EP Application No. 20 86 6406 dated Aug. 12, 2022.

* cited by examiner

HIGH-STRENGTH THIN-GAUGE CHECKERED STEEL PLATE/STRIP AND MANUFACTURING METHOD THEREFOR

CROSS-REFERENCE TO RELATED APPLICATIONS

This application is a 371 U.S. National Phase of PCT International Application No. PCT/CN2020/115955 filed on Sep. 17, 2020, which claims benefit and priority to Chinese patent application No. CN 201910888774.5 filed on Sep. 19, 2019, the contents of each of the above listed applications are incorporated by reference herein in their entireties.

TECHNICAL FIELD

The present disclosure pertains to continuous casting processes and products in the metallurgical industry, in particular to a high-strength thin-gauge checkered steel plate/strip and a manufacturing method therefor.

BACKGROUND ART

In the traditional process for steel production, tin (Sn) and copper (Cu) are typical residual elements or harmful elements in steel. It is very difficult and expensive to remove Sn and Cu fully during the steelmaking process. Generally, once the steel contains Sn and Cu, they cannot be eliminated thoroughly. Instead, the contents of Sn and Cu can only be reduced by diluting molten steel, which leads to an increased smelting cost for steel products.

In recent years, due to the repeated recycling of steel scrap, more and more steel scrap resources, and a continually decreased electricity price, short-flow steelmaking with an electric furnace based on steel scrap has risen and has been popularized. As a result, the contents of Sn, Cu and other residual elements in the steel get higher and higher. Sn and Cu in steel are elements prone to segregation, and they may be enriched easily at grain boundaries to cause defects such as cracks. Therefore, the contents of Sn and Cu elements are controlled strictly in the traditional process. In common structural steel, definite requirements are imposed on the contents of both Sn and Cu: Sn (wt %)≤0.005%; Cu (wt %)≤0.2%.

Therefore, if the residual elements such as Sn and Cu in steel (especially steel scrap) can be utilized reasonably so as to "turn harm into benefit", it will have a positive influence on the entire metallurgical industry. Particularly, effective utilization of the existing steel scrap, or low quality or poor quality mineral resources (high tin ores, high copper ores) can be achieved; the recycling of steel can be promoted; the production cost can be reduced; and the sustainable development of the steel industry can be realized.

Traditional thin strip steel is mostly produced by multi-pass continuous rolling of a cast slab having a thickness of 70-200 mm. The traditional hot rolling process is: continuous casting+cast slab reheating and heat preservation+rough rolling+finish rolling+cooling+coiling. Particularly, a cast slab having a thickness of about 200 mm is firstly obtained by continuous casting; the cast slab is reheated and held; then, rough rolling and finish rolling are performed to obtain a steel strip having a thickness generally greater than 2 mm; and finally, laminar cooling and coiling are performed on the steel strip to complete the entire hot rolling production process. If a steel strip having a thickness of less than or equal to 1.5 mm is to be produced, it is relatively difficult, because subsequent cold rolling and annealing of the hot-rolled steel strip are generally necessary. In addition, the long process flow, the high energy consumption, the large number of unit devices, and the high capital construction cost result in high production cost.

The thin slab continuous casting and rolling process flow is: continuous casting+heat preservation and soaking of the cast slab+hot continuous rolling+cooling+coiling. The main differences between this process and the traditional process are as follows: the thickness of the cast slab in the thin slab process is greatly reduced to 50-90 mm. Because the cast slab is thin, the cast slab only needs to undergo 1-2 passes of rough rolling (when the thickness of the cast slab is 70-90 mm), or does not need to undergo rough rolling (when the thickness of the slab is 50 mm). In contrast, the continuous casting slab in the traditional process needs to be rolled repeatedly for multiple passes before it can be thinned to the required gauge before finish rolling. In addition, the cast slab in the thin slab process does not undergo cooling, but enters a soaking furnace directly for soaking and heat preservation, or a small amount of heat is supplemented. Hence, the thin slab process greatly shortens the process flow, reduces energy consumption, reduces investment, and thus reduces production cost. However, due to the fast cooling rate, the thin slab continuous casting and rolling process increases the steel strength and yield ratio, thereby increasing the rolling load, so that the thickness gauge of the hot-rolled products that can be economically produced cannot be too thin, generally ≥1.5 mm. See Chinese patents CN200610123458.1, CN200610035800.2 and CN200710031548.2. Moreover, Sn and Cu elements are not involved in these patent applications.

The endless thin slab continuous casting and rolling process (ESP in short) rising in recent years is an improved process developed on the basis of the above semi-endless thin slab continuous casting and rolling process. The ESP realizes endless rolling for continuous casting of a slab, and eliminates the flame cutting of the slab and the heating furnace that is used for heat preservation, soaking and transition of slabs. The length of the entire production line is greatly shortened to about 190 meters. The slab produced by continuous casting with a continuous casting machine has a thickness of 90-110 mm and a width of 1100-1600 mm. The slab produced by continuous casting passes through an induction heating roll table to effect heat preservation and soaking on the slab. Then, the slab enters the rough rolling, finish rolling, laminar cooling, and coiling processes to obtain a hot-rolled plate. Since this process realizes endless rolling, a hot-rolled plate having a minimum thickness of 0.8 mm can be obtained, which expands the range of the gauge of hot-rolled plates. In addition, the output of a single production line can reach 2.2 million t/year. At present, this process has been developed and promoted rapidly, and there are a plurality of ESP production lines in operation around the world.

The thin strip continuous casting and rolling process has a shorter process flow than the thin slab continuous casting and rolling. The thin strip continuous casting technology is a cutting-edge technology in the research field of metallurgy and materials. Its appearance brings about a revolution to the steel industry. It changes the production process of steel strip in the traditional metallurgical industry by integrating continuous casting, rolling, and even heat treatment, so that the thin strip blank produced can be formed into a thin steel strip at one time after one pass of online hot rolling. Thus, the production process is simplified greatly, the production cycle is shortened, and the length of the process line is only about 50 m. The equipment investment is also reduced accordingly, and the product cost is significantly reduced. It is a low-carbon, environmentally friendly process for producing a hot-rolled thin strip. The twin-roll thin strip continuous casting process is the main form of the thin strip continuous casting process, and it is also the only thin strip continuous casting process that has been industrialized in the world.

A typical process flow of twin-roll thin strip continuous casting is shown by FIG. 1. The molten steel in a ladle 1 passes through a ladle shroud 2, a tundish 3, a submerged nozzle 4 and a distributor 5, and is then directly poured into a molten pool 7 formed with side sealing devices 6*a*, 6*b* and two counter-rotating crystallization rolls 8*a*, 8*b* capable of rapid cooling. The molten steel solidifies on the circumferential surfaces of the rotating crystallization rolls 8*a*, 8*b* to form a solidified shell which gradually grows, and then forms a 1-5 mm thick cast strip 11 at the minimum gap (nip point) between the two crystallization rolls. The cast strip 11 is guided by a guide plate 9 to pinch rolls 12 and sent to a rolling mill 13 to be rolled into a thin strip of 0.7-2.5 mm, and then cooled by a cooling device 14. After its head is cut off by a flying shear 16, it is finally sent to a coiler 19 to be coiled into a coil.

For iron and steel enterprises facing the severe market situation, the only way for the enterprises to survive and develop is to expand product mix, and promote economic efficiency and competitiveness. The steel mills need to produce more competitive products. Checkered plate is a hot-rolled steel plate with a pattern on its surface. As a special hot-rolled plate/strip product, it is widely used in construction, machinery manufacturing, automobiles, bridges, transportation, shipbuilding and other fields. Its market demand is relatively high. Especially, the market demand for thin-gauge checkered plates is higher. Because extremely thin gauge (≤1.5 mm) checkered plates impose high requirements on the rolling stability of a rolling mill and the coiling shape of a coiler, they can be produced only by a few domestic manufacturers. As a direct result, the market price of the thin-gauge hot-rolled checkered plates is higher than the price of the hot-rolled checkered plates having a thickness of 2.0 mm or more by 120-200 Yuan/ton. The main product types include checkered plate with round bean pattern, checkered plate with diamond pattern and checkered plate with lentil pattern. The checkered plate with lentil pattern has the characteristics of wear resistance, beautiful appearance, slip resistance, oil and water repellency, good cleanability, and less consumption of steel. So, the lentil pattern has become the mainstream pattern on checkered plates. The checkered plate with lentil pattern has a good number of application scenarios, a large market demand and a high price, and has become a high value-added variety and a typical product of hot continuous rolling enterprises. The major steel plants are competing for development and production of this type of plate.

When hot-rolled strip steel is used as a thin-gauge hot-rolled plate, high surface quality of the strip steel is required. It is generally required that the thickness of the oxide scale on the surface of strip steel should be as thin as possible. This requires control of the formation of the oxide scale on the cast strip in the subsequent stages. For example, in a typical twin-roll continuous casting process for thin strip steel, a closed chamber device is used from the crystallization rolls to the inlet of the rolling mill to prevent oxidation of the cast strip. Addition of hydrogen to the closed chamber device as disclosed in U.S. Pat. No. 6,920,912 and control of the oxygen content to be less than 5% in the closed chamber device as disclosed in US Patent Application US20060182989 can both help to control the thickness of the oxide scale on the cast strip surface. However, there are few patents related to how to control the thickness of the oxide scale in the conveying process from the rolling mill to the coiler, especially in the process of cooling the strip steel by laminar cooling or spray cooling. When the high-temperature strip steel is in contact with the cooling water, the thickness of the oxide scale on the surface of the cast strip grows rapidly. At the same time, the contact of the high-temperature strip steel with the cooling water may also cause many problems: first, water spots (rust spots) may be formed on the surface of the strip steel, which will affect the surface quality; second, cooling water for laminar cooling or spray cooling tends to cause local uneven cooling on the surface of the strip steel, resulting in a non-uniform microstructure inside the strip steel, so that the properties of the strip steel are not uniform and the product quality is affected; third, the local uneven cooling on the surface of the strip steel may cause deterioration of the strip shape, which affects the shape quality.

However, because the thin strip continuous casting process itself is characterized by rapid solidification, the steel produced by this process generally has problems such as nonuniform structure, low elongation, high yield ratio and poor formability. At the same time, the austenite grains in the cast strip are obviously not uniform, such that the structure of the final product obtained after austenite transformation is not uniform, either. Hence, the properties of the product are not stable. Therefore, it is difficult and challenging to use a thin strip continuous casting production line to produce high-strength, thin-gauge checkered plates. It is impossible to produce them by copying the traditional composition and process. Instead, a breakthrough in composition and process is required.

SUMMARY

One object of the present disclosure is to provide a high-strength thin-gauge checkered steel plate/strip and a manufacturing method therefor, wherein a twin-roll thin strip continuous casting process is employed for the production with full use of the residual harmful elements such as Sn, Cu and the like in steel scrap to achieve comprehensive utilization of steel scrap resources, and complicated intermediate processes such as slab heating, multi-pass repeated hot rolling and the like may be obviated. With the use of a twin-roll thin strip continuous casting+one-pass on-line hot rolling process, the production process is shorter, the efficiency is higher, and the investment cost for the production line and the production cost are reduced significantly. The hot-rolled high-strength thin-gauge checkered steel plate/strip produced by the process according to the present disclosure does not need to be further rolled. It can be marketed directly for use. The cost-effectiveness of plate and strip is improved significantly. It can be widely used in construction, machinery manufacturing, automobiles, bridges, transportation, shipbuilding and other fields.

To achieve the above object, the technical solution of the present disclosure is as follows:

According to the present disclosure, residual elements such as Sn and Cu in steel scrap are used as alloy elements for smelting to produce molten steel, and micro-alloy elements such as B are selectively added to the steel. In the smelting process, the basicity for slagging, the type and melting point of the inclusions in the steel, the free oxygen content in the molten steel, and the content of acid-soluble aluminum Als are controlled. Then, twin-roll thin strip continuous casting is performed to cast a strip steel having a thickness of 1.5-3 mm. After the strip steel exits crystallization rolls, it directly enters a lower closed chamber having a non-oxidizing atmosphere, and enters an on-line rolling mill for hot rolling under closed conditions. The rolled strip steel is cooled by gas atomization cooling. The gas atomization cooling can effectively reduce the thickness of the oxide scale on the surface of the strip steel, increase the temperature uniformity of the strip steel, and improve the surface quality of the strip. The final steel coil produced can be used directly as a hot rolled checkered plate/strip, or as a finished checkered plate/strip after trimming-flattening.

Specifically, the high-strength thin-gauge checkered steel plate/strip according to the present disclosure comprises the following chemical elements in weight percentages: C: ≤0.06%, Si: ≤0.5%, Mn: 0.4-1.7%, P≤0.04%, S≤0.007%, N: 0.004-0.010%, Als: <0.001%, B: 0.001-0.006%, Mn/S≥250, total oxygen $[O]_T$: 0.007-0.020%; also Cu: 0.1-0.6% and/or Sn: 0.005-0.04%; and a balance of Fe and other unavoidable impurities.

In some embodiments, the high-strength thin-gauge checkered steel plate/strip according to the present disclosure comprises the following chemical elements in weight percentages: C: 0.02-0.06%, Si: 0.1-0.5%, Mn: 0.4-1.7%, P≤0.04%, S≤0.007%, N: 0.004-0.010%, Als: <0.001%, B: 0.001-0.006%, Mn/S≥250, any one or both of Cu: 0.1-0.6% and Sn: 0.005-0.04%, total oxygen $[O]_T$: 0.007-0.020%; and a balance of Fe and other unavoidable impurities.

The checkered steel plate/strip according to the present disclosure has a pattern height h of at least 20% of a thickness a of a base plate/strip, i.e., h≥0.2a.

The structure of the checkered steel plate/strip according to the present disclosure is a mixed microstructure of acicular ferrite+pearlite.

In some embodiments, in the checkered steel plate/strip according to the present disclosure, Mn/S>250.

The checkered steel plate/strip according to the present disclosure has a yield strength of ≥345 MPa, a tensile strength of ≥470 MPa, and an elongation of ≥22%.

The checkered steel plate/strip according to the present disclosure has a thickness of 0.8-2.5 mm, preferably a thickness of 1.0-1.6 mm.

In the composition design of the checkered steel plate/strip according to the present disclosure:

C: C is the most economical and basic strengthening element in the steel. It increases the steel strength by solid solution strengthening and precipitation strengthening. C is an essential element for precipitation of cementite during austenite transformation. Hence, the level of C content largely determines the strength level of the steel. That is, a higher C content leads to a higher strength level. However, since the interstitial solid solution and precipitation of C do great harm to the plasticity and toughness of the steel, and an unduly high C content is unfavorable to the welding performance, the C content cannot be too high. The steel strength is compensated by appropriate addition of an alloy element(s). At the same time, for conventional slab continuous casting, casting in the peritectic reaction zone is prone to produce cracks in the surface of the cast slab, and breakout accidents may occur in severe cases. The same is true for thin strip continuous casting, i.e. casting in the peritectic reaction zone is prone to produce cracks in the surface of the cast strip blank, and the strip will be broken in severe cases. Therefore, the thin strip casting of Fe—C alloy also needs to circumvent the peritectic reaction zone. Hence, the content of C used according to the present disclosure is in the range of ≤0.06%. In some embodiments, the content of C is in the range of 0.02-0.06%.

Si: Si plays a role in solid solution strengthening in the steel, and the addition of Si to the steel can improve steel purity and fulfill deoxygenation. However, an unduly high content of Si will deteriorate weldability and toughness of the welding heat affected zone. Hence, the content of Si used according to the present disclosure is in the range of ≤0.5%. In some embodiments, the content of Si is in the range of 0.1-0.5%.

Mn: Mn is one of the cheapest alloy elements. It can improve the hardenability of the steel. It has a considerable solid solubility in the steel, and increases the steel strength by solid solution strengthening with substantially no damage to the plasticity or toughness of the steel. It is the most important strengthening element to improve the steel strength, and it can also play a role in deoxygenation in the steel. However, an unduly high content of Mn will deteriorate weldability and toughness of the welding heat affected zone. Hence, the content of Mn used according to the present disclosure is in the range of 0.4-1.7%.

P: If the content of P is high, it is prone to segregate at the grain boundary, so that the cold brittleness of the steel will be increased, thereby worsening the weldability, and the plasticity of the steel will be decreased, thereby worsening the cold bendability. In the thin strip continuous casting process, the solidification and cooling rate of the cast strip is extremely fast, and thus the segregation of P can be suppressed effectively. As a result, the disadvantages of P can be avoided effectively, and full use of the advantages of P can be made. Therefore, according to the present disclosure, the P content is higher than that used in the traditional production process, and the limitation to the content of P element is relaxed appropriately. The dephosphorization process is eliminated from the steelmaking process. In the practical operation, it's not necessary to perform the dephosphorization process or add phosphorus intentionally, and the content of P is in the range ≤0.04%.

S: Generally, S is a harmful element in the steel. Particularly, it introduces hot shortness to the steel, reduces the ductility and toughness of the steel, and causes cracks during rolling. S also reduces weldability and corrosion resistance. Therefore, according to the present disclosure, S is also controlled as an impurity element, and its content is in the range of ≤0.007%; in some embodiments, in the range of ≤0.0067%. In addition, Mn/S≥250. In some embodiments, Mn/S>250.

Als: In order to curb the inclusions in the steel, Al cannot be used for deoxygenation as required by the present disclosure. In the use of a refractory material, additional introduction of Al should also be avoided as far as possible, and the content of acid-soluble aluminum Als is required to be: <0.001%.

N: Similar to C element, N element can improve the steel strength by interstitial solid solution. In the present disclosure, a certain amount of N needs to exist in the steel because the interaction of N and B is necessary in the steel to generate a precipitation phase of BN. However, the interstitial solid solution of N harms the plasticity and toughness of the steel to a relatively large extent, and the existence of free N may increase the yield ratio of the steel. Hence, the N content should not be too high. The content of N used according to the present disclosure is in the range of 0.004-0.010%.

Cu: Cu mainly plays a role in solid solution strengthening and precipitation strengthening in the steel. Since Cu is an element prone to segregation, the content of Cu is generally controlled strictly in the traditional process. In view of the rapid solidification effect of thin strip continuous casting, the upper limit of Cu is increased to 0.60% according to the present disclosure. In a certain sense, the increased Cu content can realize effective utilization of copper in steel scrap or poor quality mineral resources (high-copper ore), promote the recycling of steel, reduce production cost, and achieve the purpose of sustainable development. In some embodiments, the content of Cu, if present, is in the range of 0.1-0.6%.

Sn: Sn element is also one of the main residual elements in steel scrap. It is recognized as a harmful element in steel. Because Sn is an element prone to segregation, Sn even in a small amount may be enriched at the grain boundary, resulting in defects such as cracks. Therefore, the content of Sn element is strictly controlled in the traditional process. Because thin strip continuous casting has the characteristic of rapid solidification, interdendritic segregation of an element is greatly reduced. As a result, the solid solubility of the element can be increased greatly. Therefore, under the conditions of the thin strip continuous casting process, the content range of Sn element can be expanded, and the steelmaking cost can thus be reduced greatly. FIG. 2 shows the relationship between Sn element and average heat flux. It can be seen from FIG. 2 that when the amount of Sn added is less than 0.04%, there is little influence on the heat flux. That is, there is no influence on the solidification process of the thin strip. FIG. 3 shows the relationship between Sn content and surface roughness. Because cracks on the surface of a cast strip are usually generated at the uneven folds on the surface of the cast strip, surface roughness is used to characterize the occurrence of the surface cracks. If the roughness is large, the probability of cracking is high. It can be seen from FIG. 3 that the increase of the Sn content has no adverse influence on the surface quality of the cast strip under the condition of rapid solidification. As it can be seen from the results in FIGS. 2 and 3, Sn has no adverse influence on the solidification and surface quality of the cast strip. Therefore, according to the present disclosure, the limitation to the Sn content may be further relaxed, and the designed Sn content is in the range of 0.005-0.04%.

B: The notable role of B in the steel is that a minute amount of B can multiply the hardenability of the steel. B may allow for preferential precipitation of coarse BN particles in high-temperature austenite, thereby inhibiting precipitation of fine AlN, weakening the pinning effect of the fine AlN on the grain boundary, and promoting the growth ability of grains. Hence, austenite grains are coarsened and homogenized. This is beneficial to recrystallization after rolling. The coarsening and homogenization of austenite grains further helps to improve the yield ratio of the product and improve the formability of the product. In addition, the combination of B and N can effectively prevent appearance of the low melting point phase $B_2O_3$ at the grain boundary.

B is an active element that is prone to segregation, and it tends to segregate at the grain boundary. When B-containing steel is produced by the traditional process, the B content is generally controlled very strictly, usually around 0.001-0.003%. In the thin strip continuous casting process, the solidification and cooling rate is fast. Hence, the segregation of B can be inhibited effectively, and more B can be solid dissolved. Therefore, the limitation to the B content can be relaxed appropriately. Coarse BN particles can also be produced by controlling the process appropriately to inhibit precipitation of fine AlN. In this way, B plays a role in nitrogen fixation. Therefore, a higher B content is used in the present disclosure than in the traditional process, and the range is 0.001-0.006%.

A manufacturing method for the high-strength thin-gauge checkered steel plate/strip according to the present disclosure comprises the following steps:

1) Smelting wherein smelting is performed on the above composition; wherein a basicity a=$CaO/SiO_2$ (mass ratio) for slagging in a steelmaking process is controlled at a<1.5, preferably a=<1.2, or a=0.7-1.0; wherein a $MnO/SiO_2$ ratio (mass ratio) in molten steel for producing a low-melting-point $MnO—SiO_2—Al_2O_3$ ternary inclusion is controlled at 0.5-2, preferably 1-1.8; wherein a free oxygen content $[O]_{Free}$ in the molten steel is 0.0005-0.005%; and wherein in the molten steel, Mn/S≥250;

2) Continuous Casting wherein twin-roll thin strip continuous casting is used, wherein a 1.5-3 mm thick cast strip is formed from the molten steel at a smallest gap between two crystallization rolls; wherein the crystallization rolls have a diameter of 500-1500 mm, preferably Φ800 mm; wherein water is supplied to an inside of the crystallization rolls for cooling; wherein a casting machine has a casting speed of 60-150 m/min; wherein a two-stage system for dispensing and distributing molten steel is used for molten steel delivery in the continuous casting, i.e., a tundish+a distributor;

3) Lower Closed Chamber Protection wherein after a continuously cast strip exits the crystallization rolls, the cast strip has a temperature of 1420-1480° C., and it enters a lower closed chamber directly, wherein a non-oxidizing gas is supplied to the lower closed chamber, wherein an oxygen concentration in the lower closed chamber is controlled at <5%; and wherein the cast strip has a temperature of 1150-1300° C. at an outlet of the lower closed chamber;

4) On-Line Hot Rolling wherein the cast strip is delivered through pinch rolls in the lower closed chamber to a rolling mill, and rolled into a checkered plate/strip having a thickness of 0.8-2.5 mm at a rolling temperature of 1100-1250° C. and a hot rolling reduction rate controlled at 10-50%, preferably 30-50%; wherein the hot-rolled checkered steel plate/strip has a thickness of 0.8-2.5 mm, preferably 1.0-1.6 mm;

5) Post-Rolling Cooling wherein the checkered steel plate/strip hot rolled on-line is subjected to post-rolling cooling, wherein gas atomization cooling is used for the cooling, wherein a cooling rate is 20-100° C./s; and 6) Coiling wherein the hot-rolled and cooled checkered steel plate/strip is directly coiled into a coil after a poor-quality head portion of the steel plate/strip is cut off, wherein a coiling temperature is controlled at 500-600° C.

Preferably, in step 1), an electric furnace is used for smelting to produce molten steel, wherein 100% steel scrap may be selected as the raw material for smelting without pre-screening. Alternatively, a converter is used for smelting to produce molten steel, wherein steel scrap is added to the converter in an amount of 20% of the raw material for smelting without pre-screening. Then, the molten steel is delivered to an LF furnace, VD/VOD furnace or RH furnace for refining.

Preferably, in step 3), the non-oxidizing gas includes an inert gas, $N_2$, or a mixed gas of $CO_2$ gas produced by sublimation of dry ice, $N_2$ and $H_2$.

Preferably, in step 4), rolls used for producing the checkered steel plate/strip by rolling include an upper roll and a lower roll, wherein the upper roll is an embossed roll, and the lower roll is a flat roll; wherein the upper embossed roll has a roll diameter that is 0.3-3 mm larger than a roll diameter of the lower flat roll.

Preferably, in step 4), based on a center line of a roll body of the lower flat roll, the lower flat roll has a roll diameter at a center of the lower flat roll that is 0.15-0.22 mm smaller than roll diameters at both ends, and a parabolic roll shape with smooth transition from the center to both of the ends is formed.

Preferably, in step 5), the gas atomization cooling utilizes a gas-water ratio of 15:1-10:1, a gas pressure of 0.5-0.8 MPa, and a water pressure of 1.0-1.5 MPa. The gas-water ratio refers to the flow ratio of compressed air to water, and the unit of the flow is $m^3/h$.

Preferably, in step 5), 1-2 pairs of high-pressure lateral jet nozzles are operated at an outlet where the checkered steel plate/strip comes out after atomization cooling to purge water accumulated on a surface of the checkered steel plate/strip, wherein a nozzle pressure is 0.5-0.8 MPa, and a flow rate is 20-200 $m^3/h$.

Preferably, in step 6), the coiling utilizes double-coiler coiling or Carrousel coiling.

In the manufacturing method according to the disclosure:

In the steelmaking process using the electric furnace according to the present disclosure, 100% steel scrap may be used as raw material without prescreening.

In order to save investment cost and production cost, modern steel enterprises actively carry out technological innovations in existing production processes. In view of the long process flow, multiple equipment and complexity of the existing hot-rolled strip steel production processes, many manufacturers closely combine the continuous casting and rolling technology with traditional processes to meet the requirements of the continuous casting and rolling process.

The use of a converter to provide molten steel for steelmaking requires that the manufacturer should have the conditions for providing molten iron. Generally, blast furnace ironmaking or non-blast furnace ironmaking equipment is needed. This belongs to the current long-process steel production mode. Nevertheless, since steel scrap resources are increasingly abundant nowadays, the government is advocating increasing the proportion of steel scrap supplied to converters, so as to achieve the purposes of saving energy, reducing consumption and reducing cost. The average level of steel scrap supplied to converters is about 8% in the past. Now and later, the targeted proportion of steel scrap supplied to converters is 15-25%. The proportion of steel scrap supplied to the converter according to the present disclosure can reach 20% or higher.

When an electric furnace is used to provide molten steel for steelmaking, steel scrap is used as the main raw material. In traditional processes such as die casting or thick slab continuous casting, the solidification cooling rate is only $10^{-1}$-10° C./s. Grain boundary segregation of the residual elements in the steel scrap occurs during the solidification process, which deteriorates the properties and quality of the steel, and even causes direct cracking and fracturing in severe cases. Therefore, in the traditional process, these harmful elements must be strictly controlled. In the selection of steel scrap raw materials, pre-screening is required, and some special treatments are required in the steelmaking process, such as addition of a concentrate for dilution, etc., which undoubtedly increase the production cost. Due to the need to control the steel composition, there are certain quality requirements for the steel scrap raw materials to be used. Generally, the steel scrap needs to be pre-screened and classified. In order to enhance the production efficiency, some domestic electric furnace steel plants choose to add concentrates such as purchased sponge iron, iron carbide and the like to the raw material composition to dilute the harmful elements that are difficult to be removed from the steel scrap, and thus improve the quality of the molten steel. Some domestic steel plants that have both a blast furnace and an electric furnace add self-produced molten iron into the electric furnace as a raw material in the electric furnace to improve the production efficiency of the electric furnace, thereby shortening the tapping time of the electric furnace greatly. The blending ratio of the molten iron in the electric furnace can reach 30-50%.

In order to improve the castability of the molten steel for thin strip continuous casting, the basicity $a=CaO/SiO_2$ (mass ratio) for slagging in the steelmaking process is controlled at $a<1.5$, preferably $a<1.2$, or $a=0.7$-1.0.

In order to improve the castability of the molten steel for thin strip continuous casting, it is necessary to obtain a low-melting-point $MnO—SiO_2—Al_2O_3$ ternary inclusion, as shown in the shaded area in FIG. 4. The $MnO/SiO_2$ (mass ratio) in the $MnO—SiO_2—Al_2O_3$ ternary inclusion is controlled at 0.5-2, preferably 1-1.8.

In order to improve the castability of the molten steel for thin strip continuous casting, O is an essential element to form an oxide inclusion in the steel. Since it's necessary to form the low-melting-point $MnO—SiO_2—Al_2O_3$ ternary inclusion according to the present disclosure, the free oxygen $[O]_{Free}$ is required to be in the range of 0.0005-0.005%.

In order to improve the castability of the molten steel for thin strip continuous casting, among the above components, Mn and S must be controlled to satisfy the following relationship: $Mn/S \geq 250$.

After the cast strip leaves the crystallization rolls, the cast strip has a temperature of 1420-1480° C., and it enters the lower closed chamber directly. The lower closed chamber is supplied with a non-oxidizing gas to provide anti-oxidation protection to the strip steel. The anti-oxidation protection provided by the lower closed chamber to the cast strip extends to the inlet of the rolling mill. The temperature of the cast strip at the outlet of the lower closed chamber is 1150-1300° C.

The theoretical basis for precipitation of the BN phase in the cast strip occurring in the lower closed chamber:

The thermodynamic equations between boron and nitrogen, and between aluminum and nitrogen in γ-Fe in steel are as follows:

$$BN=B+N;\ Log[B][N]=-13970/T+5.24 \quad (1)$$

$$AlN=Al+N;\ Log[Al][N]=-6770/T+1.03 \quad (2)$$

As shown by FIG. 5, the temperature at which BN begins to precipitate in the steel is around 1280° C., and the precipitation of BN levels off at 980° C., while the precipitation of AlN has just begun (the temperature at which AlN begins to precipitate is around 980° C.).

The precipitation of BN precedes AlN thermodynamically. Therefore, with the use of reasonable process control measures according to the present disclosure, the combination of B and N is completed in a lower enclosed chamber to generate coarse BN particles, thereby homogenizing the structure of austenite grains. This inhibits precipitation of fine AlN, and thus weakens the pinning effect of fine AlN on the grain boundary, so that the growth ability of grains is improved, and austenite grains are coarsened. As a result, subsequent martensite transformation is favored. In addition, the combination of B and N can effectively prevent appearance of the low-melting-point phase $B_2O_3$ at the grain boundary.

Among the rolls used for the checkered plate, the embossed roll is the upper roll, and its surface texture includes lentil-shaped features. In order to ensure that the rolled strip does not stick to the roll and that the strip comes out stably, the roll diameter of the upper embossed roll should be larger than the roll diameter of the lower flat roll by 0.3-3 mm. Since the embossed roll has no roll shape, in order to guarantee the plate shape of the checkered plate after rolling and avoid generation of intermediate waves, when the lower flat roll is made, based on the centerline of the roll body of this roll, the roll diameter at the center is made smaller than the roll diameters at both ends by 0.15-0.22 mm, and a parabolic roll shape with smooth transition from the center to both of the ends is formed. Due to the high rolling temperature according to the present disclosure, the pattern height h can reach 20% or more of the base plate thickness a, i.e., $h \geq 0.2a$.

Post-rolling cooling is performed on the on-line hot-rolled strip steel. Particularly, the strip steel is cooled by gas atomization cooling. The gas atomization cooling process can effectively reduce the thickness of the oxide scale on the strip steel surface, improve the temperature uniformity of the strip steel, and promote the surface quality of the strip steel. The gas atomization cooling utilizes a gas-water ratio of 15:1-10:1, a gas pressure of 0.5-0.8 MPa, and a water pressure of 1.0-1.5 MPa. After gas atomization, a high-pressure water mist is formed and sprayed on the surface of the steel strip. On the one hand, it plays a role in reducing the temperature of the steel strip. On the other hand, the water mist forms a dense gas film which covers the surface of the strip steel to protect the strip steel from oxidation, thereby effectively suppressing the growth of the oxide scale on the surface of the hot-rolled strip steel. With the use of this cooling process, the problems caused by traditional spraying or laminar cooling can be avoided, and the surface temperature of the strip steel can drop uniformly, so as to increase the temperature uniformity of the strip steel, and achieve the effect of homogenizing the internal microstructure. At the same time, the cooling is uniform, and the shape quality and performance stability of the strip steel can be improved. In addition, the thickness of the oxide scale on the surface of the strip steel can be reduced effectively. The cooling rate for the gas atomization cooling is in the range of 20-100° C./s.

Due to the presence of embossments on the upper surface of the checkered steel plate/strip, water is ready to accumulate on the upper surface of the checkered steel plate/strip after cooling. 1-2 pairs of high-pressure lateral jet nozzles are operated at an outlet where the checkered steel plate/strip comes out after atomization cooling to purge the water accumulated on the surface of the checkered plate/strip, wherein the nozzle pressure is 0.5-0.8 MPa, and the flow rate is 20-200 $m^3/h$.

After the poor-quality head portion of the hot-rolled and cooled strip steel is cut off with a head shear, the strip steel is directly coiled into a coil. To guarantee the coil shape and properties, the coiling temperature is controlled to be 500-600° C., so that the high-temperature austenite structure after the rolling is transformed into a mixed microstructure of acicular ferrite+pearlite.

The coiling utilizes double-coiler coiling or Carrousel coiling to ensure continuous production of the strip steel. Preferably, Carrousel coiling is utilized.

After the above manufacturing process, the final high-strength thin-gauge checkered steel plate/strip has a yield strength of at least 345 MPa, a tensile strength of at least 470 MPa, and an elongation of at least 22%. FIG. 6 is a picture of a real checkered plate produced according to the present disclosure.

Compared with the prior art, the present disclosure has the following differences and improvements:

The most significant features which distinguish the present disclosure from the existing thin strip continuous casting technology include the roll diameter of the crystallization roll and the corresponding molten steel distribution mode. The technical feature of the EUROSTRIP technology is the crystallization rolls having a large diameter of Φ1500 mm. Due to the large crystallization rolls together with the large capacity of the molten pool, it's easy to distribute the molten steel, but the cost for manufacturing the crystallization rolls and the cost for operation and maintenance are high. The technical feature of the CASTRIP technology is the crystallization rolls having a small diameter of Φ500 mm. Due to the small crystallization rolls together with the small capacity of the molten pool, it's difficult to distribute the molten steel, but the cost for manufacturing the casting machine and the cost for operation and maintenance are low. In order to address the challenge of uniform distribution of molten steel in the small molten pool, CASTRIP adopts a three-stage system for dispensing and distributing molten steel (tundish+transition piece+distributor). The use of a three-stage distribution system for molten steel leads to a direct increase in the cost of refractory materials. More importantly, the three-stage distribution system for molten steel extends the flow path of the molten steel, and the temperature drop of the molten steel is also larger. In order to achieve the required temperature of the molten steel in the molten pool, the tapping temperature needs to be increased greatly. The increased tapping temperature will lead to problems such as increased steelmaking cost, increased energy consumption and shortened life of refractory materials.

The crystallization rolls according to the present disclosure have a diameter of 500-1500 mm, with crystallization rolls having a roll diameter of Φ800 mm being preferred. A two-stage system for dispensing and distributing molten steel (a tundish+a distributor) is adopted. The molten steel flowing out of the distributor forms different distribution patterns along the roll surfaces and the two side surfaces, and flows in two paths without interfering with each other. Due to the use of a two-stage distribution system, in contrast to a three-stage distribution system, the cost of refractory materials is reduced greatly; and the flow path of the molten steel is shortened, so that the temperature drop of the molten steel is reduced, and the tapping temperature can be lowered. Compared with the three-stage distribution system, the tapping temperature can be lowered by 30-50° C. The decreased tapping temperature can effectively reduce the cost of steelmaking, save energy and prolong the life of refractory materials. The combined use of crystallization rolls having a preferred roll diameter of Φ800 mm and a two-stage system for dispensing and distributing molten steel according to the present disclosure not only meets the requirement of stable distribution of molten steel, but also achieves the goals of simple structure, convenient operation and low processing cost.

Chinese Patent Application CN107716552A discloses a method for producing a 1.4 mm thick checkered plate using a CSP process. A CSP short-flow production line is employed in this method to produce a thin-gauge checkered plate, wherein the weight reduction rate is not less than 10%, and the plate shape quality is excellent. A more advanced thin strip continuous casting and rolling process is used according to the present disclosure, and production of a checkered plate having a smaller minimum thickness of up to 1.0 mm can be realized.

Chinese Patent Application CN108486476A discloses a 700 Mpa vanadium-containing hot-rolled checkered steel plate and a method for producing the same. The traditional hot rolling process is used in this patent application to produce a micro-alloyed checkered plate product having a higher strength and a thickness in the range of 1.5-8.0 mm. Continuous production of ultra-thin-gauge products in batches cannot be realized, and continuous production is difficult. A thin strip continuous casting process is used for production according to the present disclosure, and the product thickness, strength level and process implementation are obviously different.

The literature "Trial-Rolling and Process Improvement of Thin-gauge Checkered Plate" mainly solves the process problems of a 2.3 mm thick checkered plate, and does not disclose the process and thickness gauge according to the present disclosure. The literature "Research and Application of New Rolling Technology for Extremely-thin-gauge Checkered Plate" employs an ESP short-flow process, and the thin-gauge checkered plate produced mainly has a thickness of about 1.8 mm. It has achieved relatively satisfactory results, but it is also different from the present disclosure in terms of process route and thickness gauge.

The main advantages of the present disclosure include:

1. According to the present disclosure, a high-strength thin-gauge checkered steel plate/strip is produced by a thin strip continuous casting technology, with full use of tin (Sn) and copper (Cu) in steel scrap as alloy elements and appropriate addition of trace element boron (B) to the steel. This has not been reported so far.
2. According to the present disclosure, complicated processes such as slab heating, multi-pass repeated hot rolling and the like are obviated. With the use of a twin-roll thin strip continuous casting+one-pass on-line hot rolling process, the production process is shorter, the efficiency is higher, and the investment cost for the production line and the production cost are reduced significantly.
3. According to the present disclosure, a good number of complicated intermediate steps in the traditional production process are obviated. Compared with the traditional process for producing a checkered steel plate/strip, the energy consumption and the $CO_2$ emission in the production according to the present disclosure are reduced greatly, and environment-friendly products are obtained.
4. According to the present disclosure, a thin strip continuous casting process is used to produce a hot-rolled high-strength thin-gauge checkered steel plate/strip, wherein the cast strip itself has a relatively thin thickness, and it is hot rolled on-line to a desired product thickness. So, the production of the thin-gauge product does not require further rolling, and the product may be marketed directly for use. The purpose of supplying thin-gauge, hot-rolled plates can be achieved, and the cost-effectiveness of the plates and strips can be improved significantly.
5. According to the present disclosure, with the addition of a trace amount of boron element to preferentially precipitate coarse BN particles in high-temperature austenite and inhibit precipitation of fine AlN, the pinning effect of fine AlN on the grain boundary is attenuated, and the growth ability of grains is promoted. As a result, the austenite grains are coarsened and homogenized. This is beneficial to improve the properties of the product.
6. Steel scrap containing Cu and Sn is used according to the present disclosure to "turn harm into benefit" for Cu and Sn in the steel, so as to make full use of the existing steel scrap, or low quality or poor quality mineral resources (high tin ores, high copper ores). As such, the recycling of steel scrap can be promoted; the production cost can be reduced; and the sustainable development of the steel industry can be realized.
7. According to the present disclosure, an electric furnace is used for smelting, and 100% of the raw material to be smelted may be steel scrap in a true sense. Thus, a pre-screening step is obviated, and the raw material cost can be reduced greatly. If a converter is used for smelting, steel scrap may be added to the converter in an amount of 20% or more based on the raw material to be smelted without pre-screening. This maximizes the proportion of steel scrap in the raw material charged into the converter, and thus reduces the smelting cost and energy consumption greatly.
8. According to the present disclosure, by using gas atomization cooling for the rolled strip steel, the problems caused by traditional spraying or laminar cooling can be avoided, and the surface temperature of the strip steel can drop uniformly, so as to increase the temperature uniformity of the strip steel, and achieve the effect of homogenizing the internal microstructure. At the same time, the cooling is uniform, and the shape quality and performance stability of the strip steel can be improved. In addition, the thickness of the oxide scale on the surface of the strip steel can be reduced effectively.
9. In the traditional process for cooling a slab, precipitation of alloying elements occurs, and re-dissolution of the alloying elements is insufficient when the slab is reheated, so that the utilization rate of the alloying elements is often reduced. In the thin strip continuous casting process according to the present disclosure, the high-temperature cast strip is hot rolled directly, and the added alloy elements mainly exist in a solid solution state. Thus, the utilization rate of the alloy elements can be increased.
10. The low-cost, high-strength, thin-gauge checkered plate product produced according to the present disclosure can satisfy the current market requirements to increase the strength (thinning) and reduce the weight (lightweight) of such a product. At the same time, the material cost can be saved effectively for downstream users. If the product is used in the transportation field such as cars and ships, the weight reduction can also bring these users the advantages of saving fuel or electricity consumption (new energy vehicles) and reducing exhaust emission.

11. According to the present disclosure, a Carrousel coiler is used for the hot-rolled steel strip to effectively shorten the length of the production line. At the same time, the coiling in-situ can greatly improve the control accuracy of the coiling temperature and improve the stability of the product properties.

BRIEFLY DESCRIPTION OF THE DRAWINGS

DETAILED DESCRIPTION

The present disclosure will be further described with reference to the following examples, but these examples by no means limit the present disclosure. Any changes made by those skilled in the art in the implementation of the present disclosure under the inspiration of the present specification will fall within the protection scope of the claims in the present disclosure.

Figure 1:
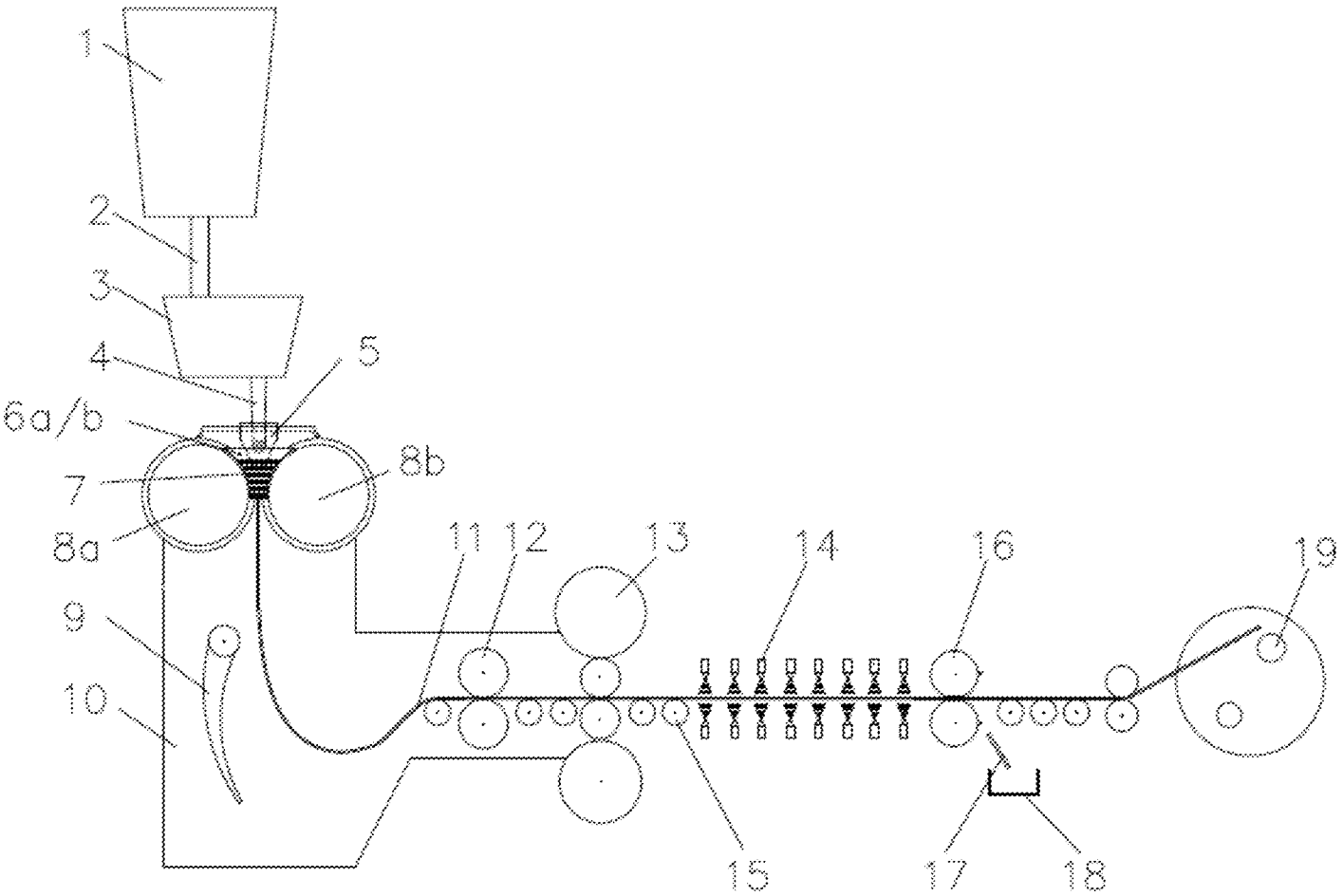
FIG. 1 is a schematic view showing the process layout of a twin-roll thin strip continuous casting process.
Figure 2:
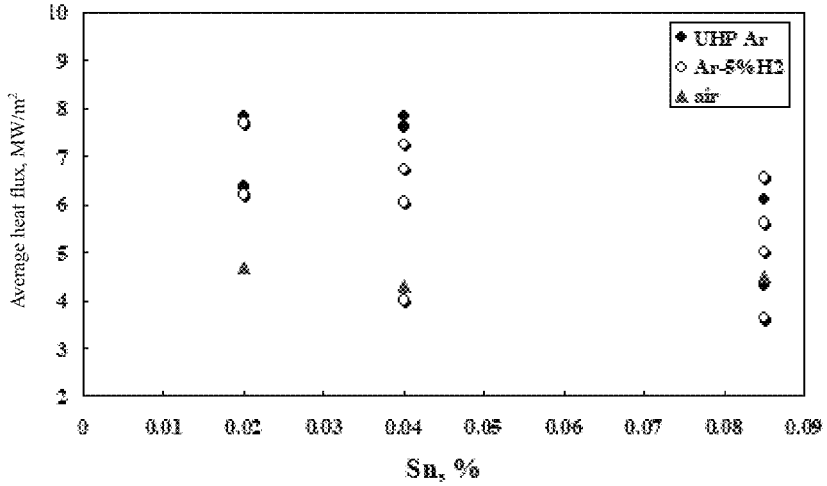
FIG. 2 is a schematic diagram showing the relationship between Sn content and average heat flux.
Figure 3:
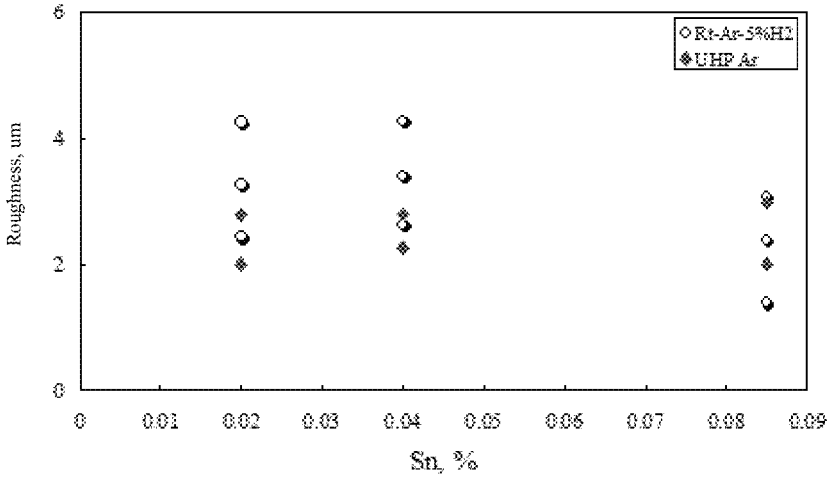
FIG. 3 is a schematic diagram showing the relationship between Sn content and cast strip surface roughness.
Figure 4:
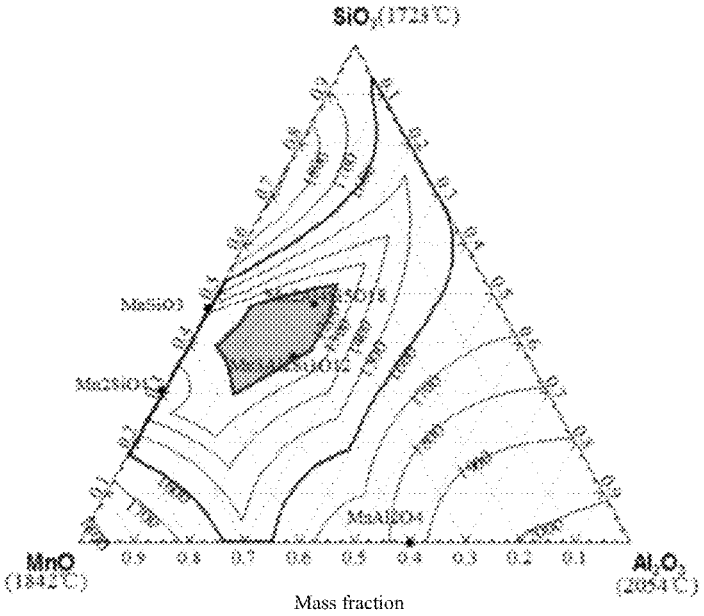
FIG. 4 is a ternary phase diagram of $MnO—SiO_2—Al_2O_3$ (shaded area: low melting point area).
Figure 5:
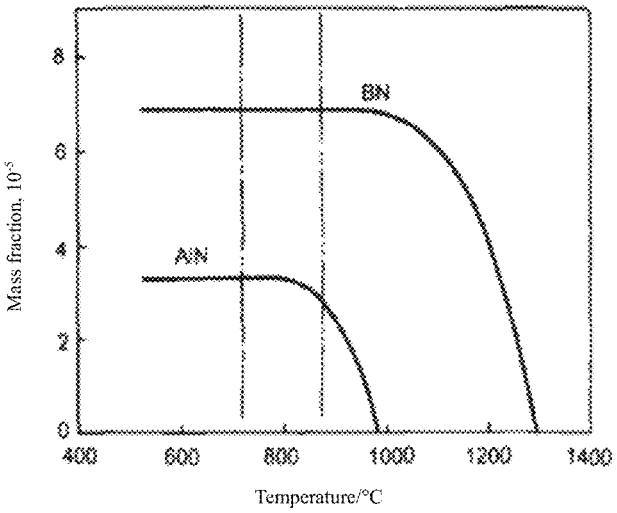
FIG. 5 is a schematic diagram showing thermodynamic precipitation curves of BN and AlN.
Figure 6:
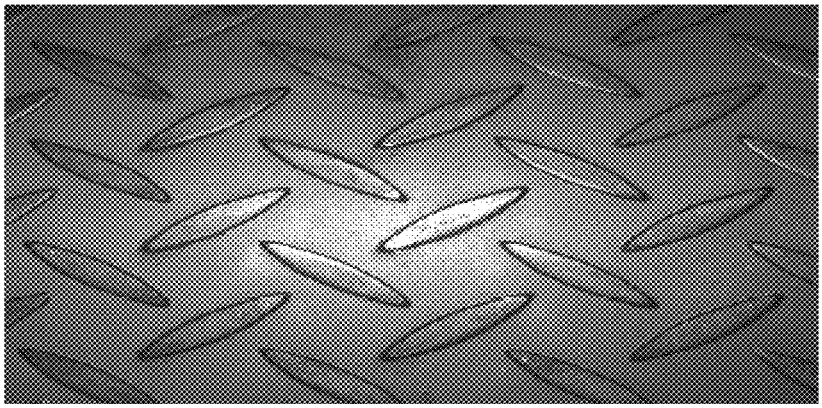
FIG. 6 is a picture of a real checkered plate produced according to the present disclosure.
Figure 7:
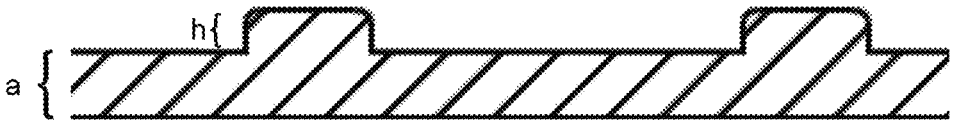
FIG. 7 is a schematic view showing the pattern thickness h of a checkered plate and the thickness a of a base plate.

Referring to FIG. 1, the molten steel that conforms to the chemical composition designed according to the present disclosure passes through a ladle 1, a ladle shroud 2, a tundish 3, a submerged nozzle 4 and a distributor 5, and is then directly poured into a molten pool 7 formed with side sealing devices 6*a*, 6*b* and two counter-rotating crystallization rolls 8*a*, 8*b* capable of rapid cooling. The molten steel solidifies on the circumferential surfaces of the rotating crystallization rolls 8*a*, 8*b* to form a solidified shell which gradually grows, and then forms a 1.5-3 mm thick cast strip 11 at the minimum gap (nip point) between the two crystallization rolls. The diameter of the crystallization rolls according to the present disclosure is between 500-1500 mm, and water is supplied to the inside of the crystallization rolls for cooling. Depending on the thickness of the cast strip, the casting speed of the casting machine is in the range of 60-150 m/min.

After the cast strip 11 exits the crystallization rolls 8*a* and 8*b*, the temperature of the cast strip is 1420-1480° C., and the cast strip enters a lower closed chamber 10 directly. The lower closed chamber 10 is supplied with an inert gas to protect the strip steel, i.e. protecting the strip steel from oxidation. The anti-oxidation protective atmosphere may be $N_2$, or Ar, or other non-oxidizing gas, such as $CO_2$ gas obtained by sublimation of dry ice. The oxygen concentration in the lower closed chamber 10 is controlled to be <5%. The anti-oxidation protection provided by the lower closed chamber 10 to the cast strip 11 extends to the inlet of the rolling mill 13. The temperature of the cast strip at the outlet of the lower closed chamber 10 is 1150-1300° C. Then, the cast strip is delivered to the hot rolling mill 13 through a swinging guide plate 9, pinch rolls 12 and a roll table 15. After hot rolling, a hot rolled strip of 0.8-2.5 mm in thickness is formed. The rolled strip steel is cooled by gas atomization cooling with the use of a gas atomization rapid cooling device 14 to improve the temperature uniformity of the strip steel. After the head portion of the strip steel is cut off by a flying shear 16, the cut head portion falls into a flying shear pit 18 along a flying shear guide plate 17, and the hot-rolled strip with the head portion cut off enters a coiler 19 for coiling. After the steel coil is taken off the coiler, it is cooled in air to room temperature. The final steel coil produced can be used directly as a hot rolled checkered plate/strip, or as a finished checkered plate/strip after trimming-flattening. Rolls used for hot rolling include an upper roll and a lower roll, wherein the upper roll is an embossed roll, and the lower roll is a flat roll; wherein the embossed roll has a surface texture including lentil-shaped features; and wherein the upper embossed roll has a roll diameter that is 0.3-3 mm larger than a roll diameter of the lower flat roll. Based on the center line of the roll body of the lower flat roll, the lower flat roll has a roll diameter at a center of the lower flat roll that is 0.15-0.22 mm smaller than roll diameters at both ends, and a parabolic roll shape with smooth transition from the center to both of the ends is formed.

The chemical compositions of the Examples according to the present disclosure are shown in Table 1, wherein the balance is Fe and other unavoidable impurities. The process parameters of the manufacturing method according to the present disclosure are shown in Table 2, and the properties of the hot-rolled strips obtained finally are shown in Table 3.

To sum up, the final high-strength thin-gauge checkered steel plate/strip manufactured with the designed steel composition using the thin strip continuous casting process according to the present disclosure has a yield strength of ≥345 MPa, a tensile strength of ≥470 MPa, and an elongation of ≥22%, and the cold bendability is qualified. The checkered steel plate/strip produced according to the present disclosure has a pattern height h of ≥20% of the thickness a of the base plate/strip, i.e., h≥0.2a. The product can be widely used in construction, machinery manufacturing, automobiles, bridges, transportation, shipbuilding and other fields.

TABLE 1

Chemical compositions of the steel Examples (wt. %)

| | C | Si | Mn | P | S | N | O | Als | Cu | Sn | B |
|---|---|---|---|---|---|---|---|---|---|---|---|
| Ex. 1 | 0.02 | 0.23 | 1.35 | 0.008 | 0.004 | 0.0074 | 0.0095 | 0.0009 | 0.33 | 0.024 | 0.003 |
| Ex. 2 | 0.03 | 0.10 | 0.90 | 0.013 | 0.003 | 0.0061 | 0.0110 | 0.0006 | 0.15 | 0.005 | 0.001 |
| Ex. 3 | 0.03 | 0.34 | 1.28 | 0.015 | 0.004 | 0.0058 | 0.0150 | 0.0004 | 0.10 | | 0.004 |
| Ex. 4 | 0.05 | 0.26 | 1.10 | 0.023 | 0.004 | 0.0087 | 0.0130 | 0.0008 | 0.55 | 0.040 | 0.006 |
| Ex. 5 | 0.04 | 0.44 | 0.65 | 0.009 | 0.002 | 0.0052 | 0.0120 | 0.0007 | 0.44 | 0.014 | 0.003 |
| Ex. 6 | 0.05 | 0.40 | 0.67 | 0.012 | 0.002 | 0.0046 | 0.0070 | 0.0008 | | 0.025 | 0.005 |
| Ex. 7 | 0.06 | 0.18 | 0.85 | 0.015 | 0.003 | 0.0040 | 0.0100 | 0.0005 | 0.37 | 0.035 | 0.003 |
| Ex. 8 | 0.03 | 0.37 | 1.00 | 0.014 | 0.004 | 0.0100 | 0.0088 | 0.0006 | 0.60 | 0.015 | 0.002 |

TABLE 1-continued

| Chemical compositions of the steel Examples (wt. %) | | | | | | | | | | | |
|---|---|---|---|---|---|---|---|---|---|---|---|
| | C | Si | Mn | P | S | N | O | Als | Cu | Sn | B |
| Ex. 9 | 0.04 | 0.36 | 0.84 | 0.018 | 0.003 | 0.0078 | 0.0200 | 0.0003 | 0.38 | | 0.004 |
| Ex. 10 | 0.05 | 0.43 | 0.40 | 0.040 | 0.001 | 0.0055 | 0.0125 | 0.0004 | 0.52 | 0.016 | 0.006 |
| Ex. 11 | 0.04 | 0.50 | 0.65 | 0.030 | 0.002 | 0.0090 | 0.0090 | 0.0005 | | 0.038 | 0.003 |
| Ex. 12 | 0.03 | 0.26 | 1.70 | 0.022 | 0.0067 | 0.0085 | 0.0118 | 0.0003 | 0.35 | 0.012 | 0.002 |
| Ex. 13 | 0.06 | 0.45 | 1.37 | 0.038 | 0.004 | 0.0045 | 0.0132 | 0.0006 | | 0.032 | 0.005 |
| Ex. 14 | 0.05 | 0.27 | 1.40 | 0.017 | 0.003 | 0.0064 | 0.0075 | 0.0005 | 0.27 | 0.027 | 0.004 |

TABLE 2

| Process parameters of the Examples | | | | | | | | |
|---|---|---|---|---|---|---|---|---|
| | Cast strip thickness mm | Atmosphere in lower closed chamber | Oxygen concentration in lower closed chamber | Hot rolling temperature ° C. | Hot rolling reduction rate/% | Hot-rolled strip thickness mm | Post-rolling cooling rate/ ° C./s | Coiling temperature ° C. |
| Ex. 1 | 2.1 | $N_2$ | 3.5 | 1180 | 29 | 1.5 | 35 | 590 |
| Ex. 2 | 2.5 | Ar | 4.2 | 1220 | 50 | 1.25 | 30 | 600 |
| Ex. 3 | 2.2 | $N_2$ | 2.5 | 1200 | 45 | 1.2 | 30 | 560 |
| Ex. 4 | 1.8 | $CO_2$ | 2.7 | 1150 | 31 | 1.25 | 20 | 550 |
| Ex. 5 | 1.5 | Ar | 3.5 | 1185 | 33 | 1.0 | 32 | 580 |
| Ex. 6 | 2.6 | Ar | 2.8 | 1100 | 42 | 1.5 | 72 | 570 |
| Ex. 7 | 1.9 | $N_2$ | 1.5 | 1190 | 21 | 1.5 | 65 | 580 |
| Ex. 8 | 1.6 | $CO_2$ | 0.8 | 1220 | 22 | 1.25 | 100 | 590 |
| Ex. 9 | 1.5 | $N_2$ | 1.5 | 1250 | 33 | 1.0 | 22 | 570 |
| Ex. 10 | 2.0 | $N_2$ | 1.9 | 1170 | 30 | 1.4 | 75 | 500 |
| Ex. 11 | 2.6 | Ar | 1.8 | 1240 | 38 | 1.6 | 30 | 575 |
| Ex. 12 | 2.2 | $N_2$ | 2.6 | 1170 | 43 | 1.25 | 60 | 585 |
| Ex. 13 | 2.0 | $CO_2$ | 2.4 | 1180 | 50 | 1.0 | 30 | 590 |
| Ex. 14 | 1.6 | Ar | 2.5 | 1160 | 31 | 1.1 | 25 | 580 |

TABLE 3

| Properties of the steel products in the Examples | | | | | | |
|---|---|---|---|---|---|---|
| Ex. | Cast strip thickness mm | Final product thickness mm | Yield strength MPa | Tensile strength MPa | Elongation/ % | 180° Bend diameter d = 3a (a is strip thickness) |
| Ex. 1 | 2.1 | 1.5 | 355 | 485 | 23 | Pass |
| Ex. 2 | 2.5 | 1.25 | 348 | 480 | 26 | Pass |
| Ex. 3 | 2.2 | 1.2 | 370 | 493 | 24 | Pass |
| Ex. 4 | 1.8 | 1.25 | 354 | 478 | 27 | Pass |
| Ex. 5 | 1.5 | 1.0 | 363 | 474 | 25 | Pass |
| Ex. 6 | 2.6 | 1.5 | 348 | 485 | 24 | Pass |
| Ex. 7 | 1.9 | 1.5 | 358 | 475 | 22 | Pass |
| Ex. 8 | 1.6 | 1.25 | 352 | 495 | 23 | Pass |
| Ex. 9 | 1.5 | 1.0 | 361 | 503 | 27 | Pass |
| Ex. 10 | 2.0 | 1.4 | 358 | 520 | 25 | Pass |
| Ex. 11 | 2.6 | 1.6 | 356 | 487 | 24 | Pass |
| Ex. 12 | 2.2 | 1.25 | 359 | 490 | 27 | Pass |
| Ex. 13 | 2.0 | 1.0 | 356 | 475 | 23 | Pass |
| Ex. 14 | 1.6 | 1.1 | 360 | 490 | 26 | Pass |

According to the present disclosure, the thin strip continuous casting process is used to produce a thin-gauge checkered plate. Due to the thin thickness, the thin strip continuous casting process has strong manufacturing and cost advantages for a thin-gauge hot-rolled high-strength product having a thickness of less than or equal to 1.5 mm. The characteristic thickness of the thin-gauge checkered plate directly supplied in the form of a hot-rolled product is 1.0-1.6 mm. Due to the thin thickness of the product, if the traditional production line process is used to produce it, problems related with the plate shape of the product will occur, and it cannot be produced. If it's produced using the thin slab continuous casting and rolling process, the roll consumption of the rolling rolls also increases significantly. Such a production process will undoubtedly increase the production cost of the thin-gauge checkered plate. Therefore, the use of the thin strip continuous casting process to produce a thin-gauge high-strength checkered plate product can not only meet the market's requirements for high strength, thin gauge and light weight, but also reduce the production cost of the checkered plate and improve the product profitability and competitiveness.

What is claimed is:

1. A checkered steel plate/strip, consisting of the following chemical elements in weight percentages: C: ≤0.06%, Si: ≤0.5%, Mn: 0.4-1.7%, P≤0.04%, S≤0.007%, N: 0.004-0.010%, Als: <0.001%, B: 0.001-0.006%, Mn/S≥250, total oxygen $[O]_T$: 0.007-0.020%; Cu: 0.1-0.6% and/or Sn: 0.005-0.04%; and a balance of Fe and other unavoidable impurities, wherein the checkered steel plate/strip has a yield strength of ≥345 MPa, a tensile strength of ≥470 MPa, and an elongation of ≥22%, wherein the checkered steel plate/strip has a thickness of 0.8-2.5 mm, and wherein the checkered steel plate/strip has a microstructure that is a mixed microstructure consisting of acicular ferrite and pearlite.

2. The checkered steel plate/strip according to claim 1, wherein the checkered steel plate/strip consists of the following chemical elements in weight percentages: C: 0.02-0.06%, Si: 0.1-0.5%, Mn: 0.4-1.7%, P≤0.04%, S≤0.007%, N: 0.004-0.010%, Als: <0.001%, B: 0.001-0.006%, Mn/S≥250, any one or both of Cu: 0.1-0.6% and Sn: 0.005-0.04%, total oxygen $[O]_T$: 0.007-0.020%; and a balance of Fe and other unavoidable impurities.

3. The checkered steel plate/strip according to claim 1, wherein the checkered steel plate/strip has a pattern height h of at least 20% of a thickness a of a base plate/strip, i.e., h≥0.2a.

4. The checkered steel plate/strip according to claim 1, wherein the checkered steel plate/strip has a thickness of 1.0-1.6 mm.

5. A manufacturing method for the checkered steel plate/strip according to claim 1, comprising the following steps:

1) Smelting, wherein smelting is performed on the composition defined in claim 1; wherein a basicity a=$CaO/SiO_2$ (mass ratio) for slagging in a steelmaking process is controlled at a<1.5; wherein a $MnO/SiO_2$ ratio (mass ratio) in a $MnO—SiO_2—Al_2O_3$ ternary inclusion produced from molten steel is controlled at 0.5-2; wherein a free oxygen content $[O]_{Free}$ in the molten steel is 0.0005-0.005%; and wherein in the molten steel, Mn/S≥250;

2) Continuous casting wherein twin-roll thin strip continuous casting is used, wherein a 1.5-3 mm thick cast strip is formed from the molten steel at a smallest gap between two crystallization rolls; wherein the crystallization rolls have a diameter of 500-1500 mm; wherein water is supplied to an inside of the crystallization rolls for cooling; wherein a casting machine has a casting speed of 60-150 m/min; wherein a two-stage system for dispensing and distributing molten steel is used for molten steel delivery in the continuous casting, i.e., a tundish+a distributor;

3) Lower closed chamber protection wherein after a cast strip exits the crystallization rolls, the cast strip has a temperature of 1420-1480° C., and it enters a lower closed chamber directly, wherein a non-oxidizing gas is supplied to the lower closed chamber, wherein an oxygen concentration in the lower closed chamber is controlled at <5%; and wherein the cast strip has a temperature of 1150-1300° C. at an outlet of the lower closed chamber;

4) On-line hot rolling wherein the cast strip is delivered through pinch rolls in the lower closed chamber to a rolling mill, and rolled into a checkered plate having a thickness of 0.8-2.5 mm at a rolling temperature of 1100-1250° C. and a hot rolling reduction rate controlled at 10-50%; wherein the hot-rolled checkered steel plate/strip has a thickness of 0.8-2.5 mm;

5) Post-rolling cooling wherein the checkered steel plate/strip after the on-line hot rolling is subjected to post-rolling cooling, wherein gas atomization cooling is used for the cooling, wherein a cooling rate is 20-100° C./s; and 6) Coiling wherein the hot-rolled strip steel is coiled into a coil after the cooling, wherein a coiling temperature is controlled at 500-600° C.

6. The manufacturing method for the checkered steel plate/strip according to claim 5, wherein in step 1), an electric furnace is used for the smelting to produce the molten steel, wherein 100% steel scrap is selected as a raw material for the smelting without pre-screening; or a converter is used for the smelting to produce the molten steel, wherein steel scrap is added to the converter in an amount of ≥20% based on a raw material for the smelting without pre-screening; wherein the molten steel is then delivered to an LF furnace, VD/VOD furnace or RH furnace for refining.

7. The manufacturing method for the checkered steel plate/strip according to claim 5, wherein in step 3), the non-oxidizing gas comprises an inert gas, $N_2$, $CO_2$ gas produced by sublimation of dry ice, or a mixed gas of $N_2$ and $H_2$.

8. The manufacturing method for the checkered steel plate/strip according to claim 5, wherein in step 4), rolls used for producing the checkered steel plate/strip by rolling include an upper roll and a lower roll, wherein the upper roll is an embossed roll, and the lower roll is a flat roll; wherein the embossed roll has a surface texture including; and wherein the upper embossed roll has a roll diameter that is 0.3-3 mm larger than a roll diameter of the lower flat roll.

9. The manufacturing method for the checkered steel plate/strip according to claim 8, wherein in step 4), based on a center line of a roll body of the lower flat roll, the lower flat roll has a roll diameter at a center of the lower flat roll that is 0.15-0.22 mm smaller than roll diameters at both ends.

10. The manufacturing method for the checkered steel plate/strip according to claim 5, wherein in step 5), the gas atomization cooling utilizes a gas-water flow ratio of 15:1-10:1, a gas pressure of 0.5-0.8 MPa, and a water pressure of 1.0-1.5 MPa, wherein the flow has a unit of $m^3/h$.

11. The manufacturing method for the checkered steel plate/strip according to claim 5, wherein in step 5), 1-2 pairs of high-pressure lateral jet nozzles are operated at an outlet where the checkered steel plate/strip comes out after atomization cooling to purge water accumulated on a surface of the checkered steel plate/strip, wherein a nozzle pressure is 0.5-0.8 MPa, and a flow rate is 20-200 $m^3/h$.

12. The manufacturing method for the checkered steel plate/strip according to claim 5, wherein in step 6), the coiling utilizes double-coiler coiling or Carrousel coiling.

13. The manufacturing method for the checkered steel plate/strip according to claim 5, wherein in step 6), the hot-rolled and cooled checkered steel plate/strip is coiled after a poor-quality head portion of the steel plate/strip is cut off.

14. The manufacturing method for the checkered steel plate/strip according to claim 5, wherein the checkered steel plate/strip consisting of the following chemical elements in weight percentages: C: 0.02-0.06%, Si: 0.1-0.5%, Mn: 0.4-1.7%, P≤0.04%, S≤0.007%, N: 0.004-0.010%, Als:

<0.001%, B: 0.001-0.006%, Mn/S≥250, any one or both of Cu: 0.1-0.6% and Sn: 0.005-0.04%, total oxygen $[O]_T$: 0.007-0.020%; and a balance of Fe and other unavoidable impurities.

15. The manufacturing method for the checkered steel plate/strip according to claim 5, wherein the basicity a=CaO/$SiO_2$ (mass ratio) for slagging in a steelmaking process is controlled at a<1.2, or a=0.7-1.0; and/or the MnO/$SiO_2$ ratio (mass ratio) in a MnO—$SiO_2$—$Al_2O_3$ ternary inclusion produced from molten steel is controlled at 1-1.8; and/or the crystallization rolls have a diameter of 800 mm; and/or the hot rolling reduction rate controlled at 30-50%; and/or the hot-rolled checkered steel plate/strip has a thickness of 1.0-1.6 mm.

16. The manufacturing method for the checkered steel plate/strip according to claim 5, wherein the checkered steel plate/strip has a pattern height h of at least 20% of a thickness a of a base plate/strip, i.e., h≥0.2a.

* * * * *